US008689879B2

(12) United States Patent
Patel et al.

(10) Patent No.: US 8,689,879 B2
(45) Date of Patent: Apr. 8, 2014

(54) FLUID DISPLACEMENT METHODS AND APPARATUS FOR HYDROCARBONS IN SUBSEA PRODUCTION TUBING

(75) Inventors: Dinesh R. Patel, Sugar Land, TX (US); Jean-Luc Monnac, Chavenay (FR); Christopher Taor, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 228 days.

(21) Appl. No.: 13/083,031

(22) Filed: Apr. 8, 2011

(65) Prior Publication Data

US 2011/0247828 A1 Oct. 13, 2011

Related U.S. Application Data

(60) Provisional application No. 61/322,205, filed on Apr. 8, 2010.

(51) Int. Cl.
*E21B 7/12* (2006.01)

(52) U.S. Cl.
USPC ..... 166/348; 166/90.1; 166/311; 166/312; 166/92.1

(58) Field of Classification Search
USPC ..... 166/90.1, 311, 312, 92.1, 95.1, 75.13, 166/97.1, 268, 347; 285/123.1, 123.2, 285/124.1
See application file for complete search history.

(56) References Cited

U.S. PATENT DOCUMENTS

| | | | | |
|---|---|---|---|---|
| 4,646,839 | A * | 3/1987 | Rickey | 166/335 |
| 5,458,198 | A * | 10/1995 | Hashemi et al. | 166/312 |
| 6,102,125 | A * | 8/2000 | Calder | 166/359 |
| 6,142,232 | A * | 11/2000 | Troutt et al. | 166/312 |
| 6,298,919 | B1 * | 10/2001 | Browne et al. | 166/373 |
| RE37,995 | E | 2/2003 | Barrus et al. | |
| 6,668,931 | B1 * | 12/2003 | Tomlinson et al. | 166/311 |
| 6,857,486 | B2 | 2/2005 | Chitwood et al. | |
| 7,150,325 | B2 * | 12/2006 | Ireland et al. | 166/366 |
| 7,565,931 | B2 * | 7/2009 | Saucier | 166/344 |
| 7,677,320 | B2 * | 3/2010 | Shaw et al. | 166/368 |
| 2002/0167242 | A1 | 11/2002 | Liu et al. | |
| 2004/0094305 | A1 | 5/2004 | Skjaerseth et al. | |
| 2007/0062690 | A1 * | 3/2007 | Witcher | 166/222 |
| 2008/0230228 | A1 | 9/2008 | Askeland | |
| 2009/0266537 | A1 | 10/2009 | Hansen et al. | |
| 2010/0236786 | A1 * | 9/2010 | Sbordone et al. | 166/360 |

FOREIGN PATENT DOCUMENTS

WO 2010/020956 A2 2/2010

* cited by examiner

*Primary Examiner* — Matthew Buck
*Assistant Examiner* — Aaron Lembo
(74) *Attorney, Agent, or Firm* — Jim Patterson

(57) ABSTRACT

The method for subsea well intervention includes creating a lubricator section within the production tubing of the well. The lubricator section can then be flushed of hydrocarbons facilitating further well intervention from the open water. An intervention device that facilitates flushing production tubing that has equipment, such as electric submersible pumps, is deployed in the wellhead, for example in the valve tree.

19 Claims, 6 Drawing Sheets

FLUID DISPLACEMENT METHODS AND APPARATUS FOR HYDROCARBONS IN SUBSEA PRODUCTION TUBING

RELATED APPLICATIONS

This application claims the benefit of U.S. Provisional Patent Application No. 61/322,205 filed on Apr. 8, 2010.

BACKGROUND

This section provides background information to facilitate a better understanding of the various aspects of the invention. It should be understood that the statements in this section of this document are to be read in this light, and not as admissions of prior art.

The invention relates to subsea well interventions, and more specifically to hydrocarbon evacuation of the production tubing to perform an environmentally safe well intervention.

Subsea wells are typically completed in generally the same manner as conventional land wells and are subject to similar service requirements as land wells. Further, as with land wells, services performed by intervention can often increase the production from the subsea well. However, intervention into a subsea well to perform the desired services is typically more difficult than for land wells. Conventionally, to perform subsea intervention, the operator must deploy a rig (such as a semi-submersible rig) or a vessel, as well as a marine riser, which is a large tubular that extends from the rig or vessel to the subsea wellhead equipment.

Interventions may be performed for various reasons. For example, an operator may observe a drop in production or some other problem in the well. In response, the operator performs an intervention operation, which may involve running a monitoring tool into the subsea well to identify the problem. Depending on the type of problem encountered, the intervention can further include shutting in one or more zones, pumping a well treatment into a well, lowering tools to actuate downhole devices (e.g., valves), placing the well on secondary recovery (e.g., installing an in-well pump), and so forth.

Performing intervention operations with large vessels and heavy equipment such as marine riser equipment, as conventionally done, is typically time consuming, labor intensive, and expensive. Therefore, a need continues to exist for less costly and more convenient intervention solutions for subsea wells.

SUMMARY

A subsea well according to one or more aspects of the invention comprises production tubing having a double barrier positioned downhole from a valve tree, an intervention device deployed in the valve tree, the intervention device comprising a fluid conduit extending to a position within the production tubing, and an isolation plug removably disposed in the fluid conduit.

The intervention device according to one or more aspects of the invention may include a body having a bottom portion sealingly deployed in a tubing hanger and an upper portion sealing disposed through a tree cap. The fluid conduit may include a tubular extending from the body to the position within the production tubing. More than one isolation plug may be disposed in the fluid conduit. In one embodiment, a lower isolation plug is positioned in the fluid conduit between the tubing hanger and the tree cap and an upper isolation plug is positioned in the fluid conduit above the tree cap relative to the production tubing.

A device such as an electric submersible pump ("ESP") can be deployed in the production tubing between the intervention device and the double barrier, wherein the fluid conduit extends to the position in the wellbore proximate to the ESP.

A method for subsea well intervention according to one or more aspects of the invention includes creating a lubricator section in the subsea well between a double barrier deployed in production tubing and an intervention device deployed proximate a wellhead; connecting coil tubing to the lubricator section through the intervention device deployed in the production tubing proximate to the wellhead; and circulating a clean fluid through the coil tubing and the lubricator section.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
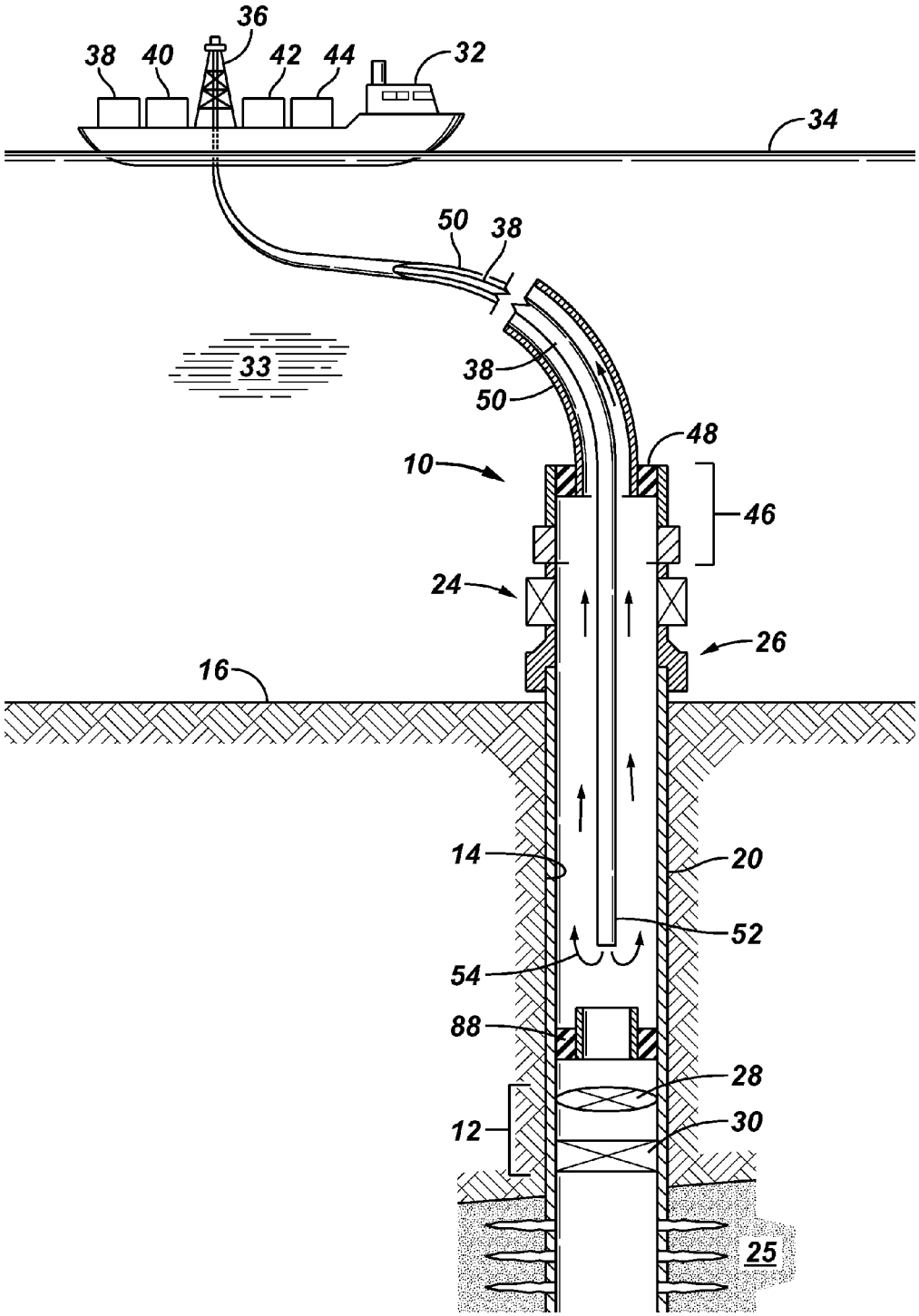
FIG. 1 is a schematic illustration of an embodiment of a subsea well system according to one or more aspects of the invention depicting a method of flushing the production tubing in preparation for an intervention.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the well being the lowest point, wherein the well (e.g., wellbore, borehole) is vertical, horizontal or slanted relative to the surface.

FIG. 1 is a schematic illustration of an embodiment of a subsea well system, generally denoted by the numeral 10, according to one or more embodiments of the invention prepared for an intervention. System 10 comprises a wellbore 14 extending from the seafloor 16 into the subterranean formations 18. Wellbore 14 is completed with production tubing 20 suspended from a tubing hanger 60 (FIGS. 2-6), deployed in tree 24 (i.e., Christmas tree, valve tree, wellhead tree) at wellhead 26 in the depicted embodiment. According to one or more aspects of the invention, the subsea well is completed downhole with a double pressure barrier 12 comprising a first valve 28, referred to herein as a downhole lubricator valve, installed in production tubing 20 between tree 24 and a second valve 30, referred to herein as the downhole safety valve. As will be further understood with reference to the present disclosure, downhole double pressure barrier 12 facilitates intervening in the subsea well, for example to deploy and retrieve equipment (e.g., in-well pumps, sensors, logging tools, well testing, etc.) without the use of heavy pressure control equipment.

In preparation for performing the intervention a vessel 32, depicted as a light intervention vessel, is deployed at the surface 34 of the water 33. Vessel 32 includes various equipment, such as a deploying devices 36 (e.g., compensated lift crane, winch), coiled tubing 38, pumps 40, liquid storage tanks 42 (e.g., clean fluid, hydrocarbon fluids, etc.), and operational devices 44 which includes for example processor based controllers, electric and hydraulic power sources, and the like. A lubricator 46 comprising a dynamic seal 48 (e.g., traveling barrier) is connected to tree 24. Coiled tubing 38 is deployed through a guide 50 (e.g., riser) from vessel 32 into lubricator 46 for entry into production tubing 20.

The devices of the invention facilitate methods for flushing (e.g., displacing, evacuating) hydrocarbons from production tubing 20 prior to performing the intervention to prevent any unacceptable amount of hydrocarbons to be released into the sea. When double pressure barrier 12 is closed (i.e., lubricator valve 28 and safety valve 30 closed) the upper portion of the production tubing 20 is isolated from the pressure bearing zones 25 for example. When the production tubing 20 is free of installation of any devices, such as an in well pump, access to production tubing 20 can be established using the coil tubing 38 deployed through the guide 50 into the lubricator 46 and into production tubing 20. The bottom end 52 of coiled tubing 38 can be deployed for example proximate the depth of downhole lubricator valve 28 and a fluid 54 can be pumped from vessel 32 through coiled tubing 38 and circulated through the production tubing 20 and returned to vessel 32 through coiled tubing-guide annulus 56. Upon flushing of the hydrocarbons from production tubing 20, the subsea well is accessible through open water 33 so that any equipment can be run in and installed in the tubing, for example as depicted in FIG. 2.

Figure 2:
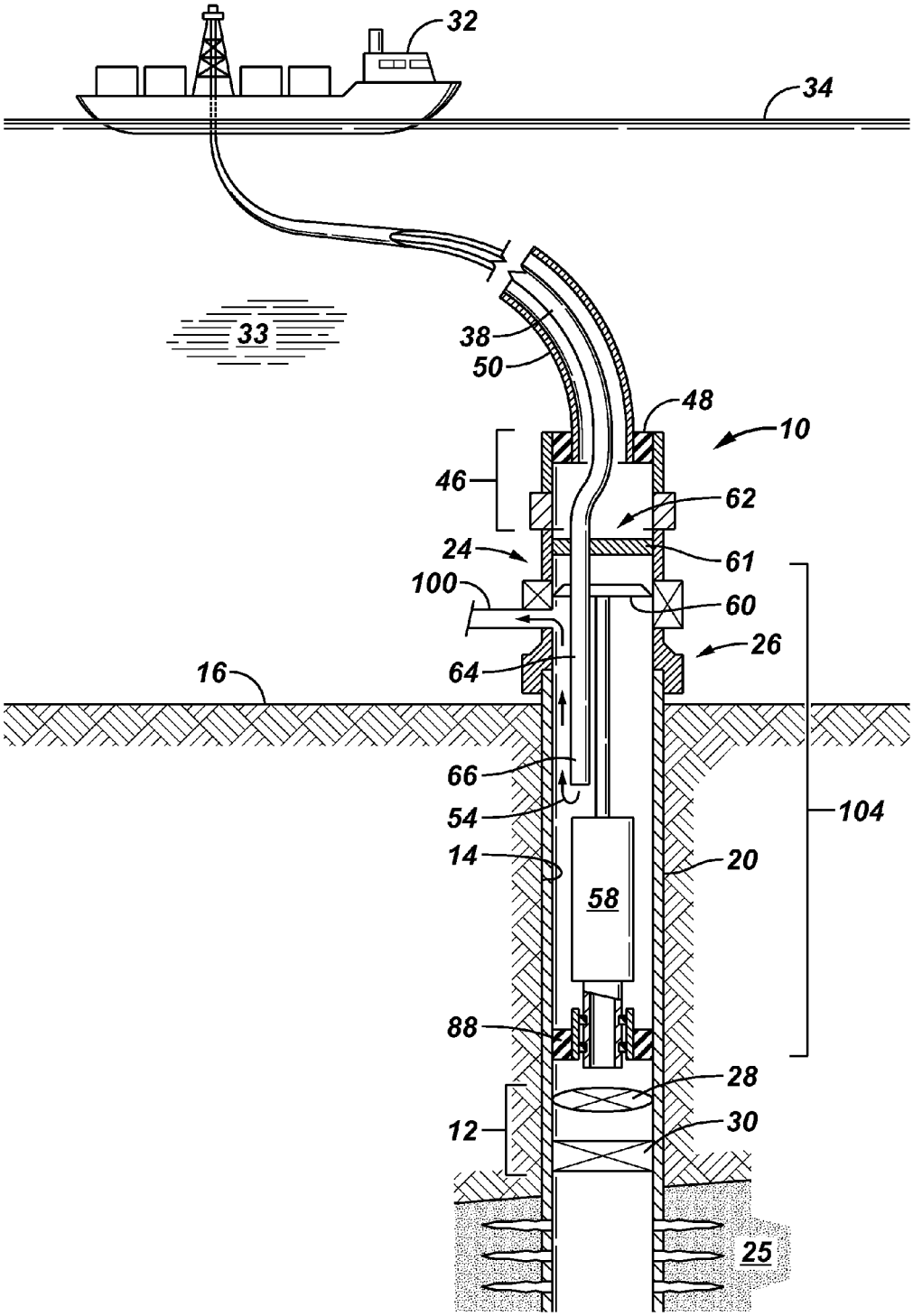
FIG. 2 is a schematic illustration of an embodiment of a subsea well system according to one or more aspects of the invention depicting a method for flushing production tubing that comprises equipment such as the depicted electric submersible pump.

FIG. 2 is a schematic illustration of a subsea well system 10 according to one or more embodiments of the invention depicting a method of flushing production tubing 20 that comprises installed equipment 58. In the depicted embodiment, an in-well pump 58 (e.g., electric submersible pump) is deployed in production tubing 20 from a tubing hanger 60. According to one or more aspects of the invention, a method of flushing the production tubing so that subsea well is accessible through open water is facilitated by creating a lubricator section 104 in production tubing 20. The depicted lubricator section 104 is formed between downhole double barrier 12 and an intervention device 62 deployed proximate wellhead 26, for example at tree 24. In the embodiment depicted in FIG. 2, device 62 is deployed from tubing hanger 60 and comprises a tubular (e.g., coiled tubing, jointed tubing) extension 64 of a fluid conduit 72 that extends down into production tubing 20 to a position wherein a bottom end 66 of tubular extension 64 (i.e., fluid conduit) is disposed proximate to the in-well pump 58. As further described below, isolation plug(s), identified generally by the numeral 86, are disposed in the fluid path of fluid conduit extension 64 which can be removed by conventional intervention (e.g., crown plug) removable devices and methods. Coil tubing 38 can be fluidicly connected to the fluid conduit extension 64 of device 62 and intervention plug(s) 86 removed to facilitate flushing of production tubing 20. A clean fluid 54 can be pumped from vessel 32 (FIG. 1) through coiled tubing 38 and through device 62 into lubricator section 104 of production tubing 20 and circulated out of a production line 100 at wellhead 26 (i.e., tree 24) thereby flushing lubricator section 104 so that intervention operations can be performed in lubricator section 104 through open water 33.

Figure 3:
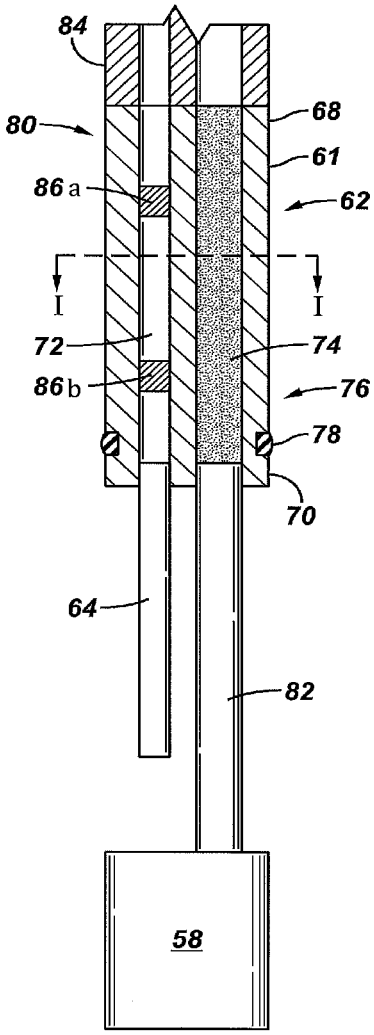
FIG. 3 is a sectional view of an embodiment of an intervention device according to one or more aspects of the invention.
Figure 4:
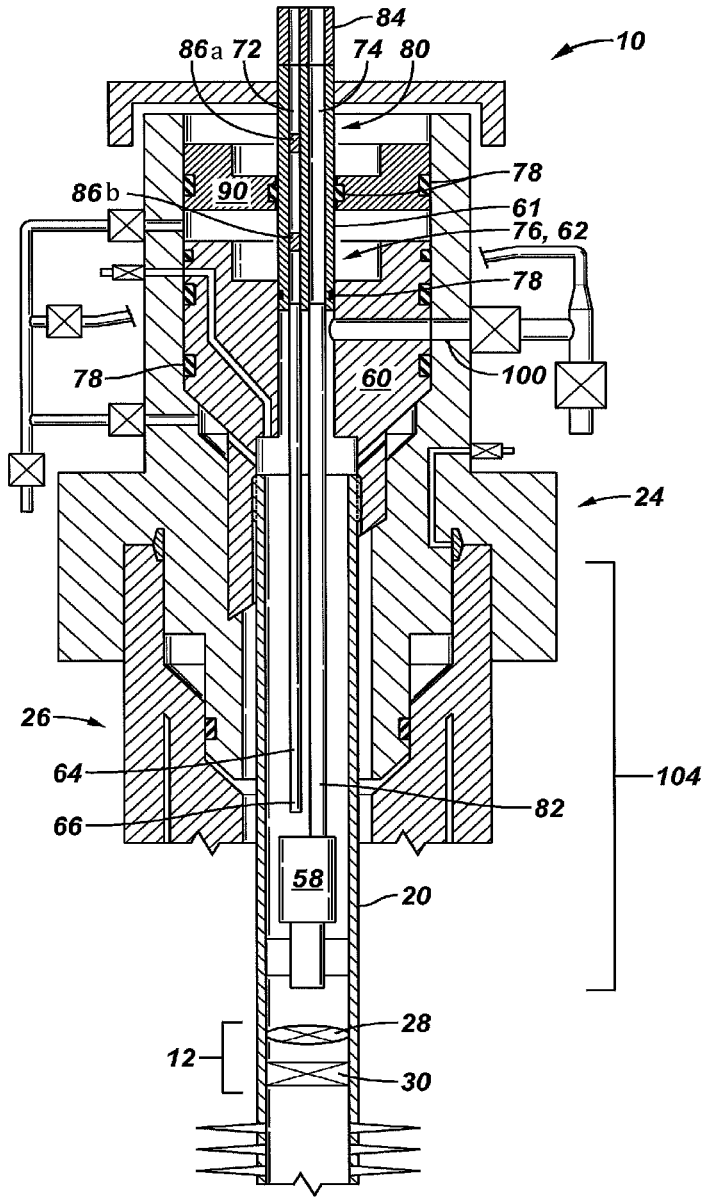
FIG. 4 is a schematic sectional view of a well system comprising a unitary embodiment of the intervention device of FIG. 3 according to one or more aspects of the invention.

Refer now to FIGS. 3 and 4 wherein an embodiment of an intervention device 62 according to one or more aspects of the invention is described. FIG. 3 is a sectional view of intervention device 62. Intervention device 62 comprises a body 61 having a top end 68, a bottom end 70, and a fluid conduit 72 formed longitudinally through body 61 relative to the vertical or longitudinal axis of wellhead 62. Fluid conduit 72 comprises tubular extension 64, also referred to from time to time as the fluid conduit extension, which extends from bottom end 70. Intervention device 62 may comprise only fluid conduit 72 or one or more additional conduits. According to one or more embodiments, intervention device comprises fluid conduit 72 and a second conduit 74, also referred to as a communication conduit, formed longitudinally through body 61. The lower portion 76 of device 62, proximate to bottom end 70, may also be referred to as a coiled tubing hanger section 76 and may comprise seal members 78. The upper portion 80 of device 62 may also be referred to as the isolation plug section 80. Body 61 may be constructed as a unitary device such as depicted in FIGS. 3 and 4 or body 61 may comprise one or more interconnected devices such as the segmented embodiment depicted and described with reference to FIGS. 5 and 6.

Fluid conduit 72 comprises tubular extension 64 which extends below bottom end 70 when installed in the subsea well, thereby extending the length of fluid conduit 72 below body 61. Fluid conduit 72 includes two isolation plug devices 86 providing a fluidic and pressure seal through fluid conduit 72. Isolation plug devices 86 can be removed with conventional intervention techniques, for example using wireline or coiled tubing. Second conduit 74, also referred to a communication conduit in this embodiment, provides a power and communication interface between production tubing and exterior of the well. For example, communication conduit 74 may comprise electrical lines, fiber optics, hydraulic conduits that may be utilized to provide continuity during operations. For example, the electrical lines may extend to the in-well pump 58, the hydraulic lines for chemical injection and/or operating other completion devices (e.g., valves), and fiber optics for example for sensors and communications. Communication conduit 74 is sealed around the electrical, hydraulic and fiber optic lines (see FIG. 7). In the depicted embodiment, communication conduit 74 comprises a tubular extension 82 extending from bottom end 70 of device 62 to in-well pump 58. A wet connect 84 is depicted at top end 68 of device 62 for connecting coil tubing 38 to device 62. Fluid conduit 72 and communication conduit 74 are depicted in a side-by-side configuration in FIGS. 3 to 6; however, the dual conduits 72, 74 can be arranged in various configurations.

Figure 7:
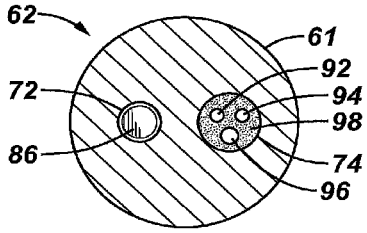
FIG. 7 is a sectional view of an embodiment of the intervention device along the line I-I of FIG. 6.

FIG. 4 is a schematic sectional view of well system 10 comprising a unitary embodiment of intervention device 62 deployed. Device 62 is depicted with coiled tubing hanger section 76 deployed from tubing hanger 60. A seal (i.e., fluidic and pressure seal) is provided across coil tubing hanger section 76 by the exterior seal (i.e., seal members 78) at the exterior surface of body 61 and tubing hanger 60, by isolation plug elements 86 disposed in fluid conduit 72, and seal material 98 provided in communication conduit 74 (FIG. 7). In this embodiment, communication conduit 74 via extension 82 is depicted extending to in-well pump 58 for example to operationally connect (e.g., electrically connect) in-well pump 58 and vessel 32 (FIG. 1). In-well pump 58 is also shown landed at seal assembly 88 (FIG. 2) in production tubing 20. Device 62 (i.e., body 61) extends upward from tubing hanger 60 through internal tree cap 90 (e.g., high pressure cap). A seal is provided across tree cap 90 by isolation plugs 86 disposed in fluid conduit 72, and sealed communication conduit 74, and by seals 78 at the exterior interface between body 61 and tree cap 90. In the depicted embodiment, an upper isolation plug 86*a* is disposed in fluid conduit 72 above tree cap 90 and a lower isolation plug 86*b* is disposed in fluid conduit 72 below tree cap 90. Thus, intervention device 62 provides an interface for operationally connecting to lubricator section 104 from exterior of the subsea well. For example, intervention device 62 provides an interface for operationally connecting pumps and clean fluid from vessel 32 to lubricator section 104 through coil tubing 38. According to some embodiments, communication and/or power can be provided to elements such as in-well pump 58 through the communication interface (i.e., communication conduit 74). For example, electric source 44 at vessel 32 (FIG. 1) can be operationally connected to in-well pump 58 through the interface of intervention device 62.

Figure 5:
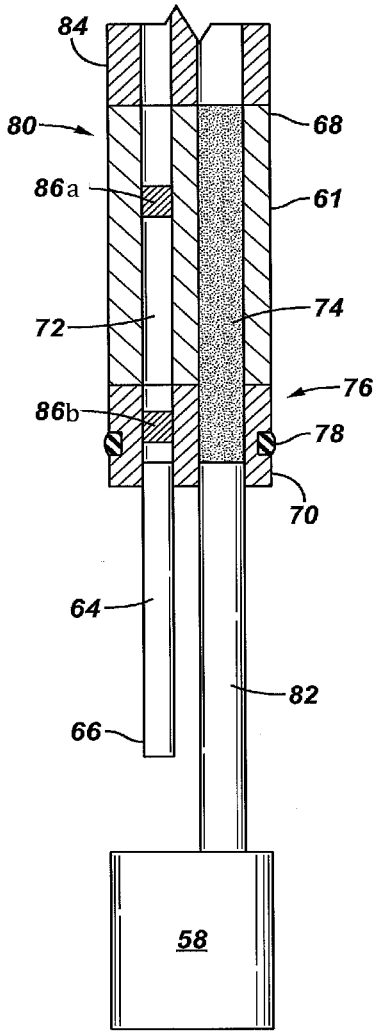
FIG. 5 is a sectional view of another embodiment of an intervention device according to one or more aspects of the invention.
Figure 6:
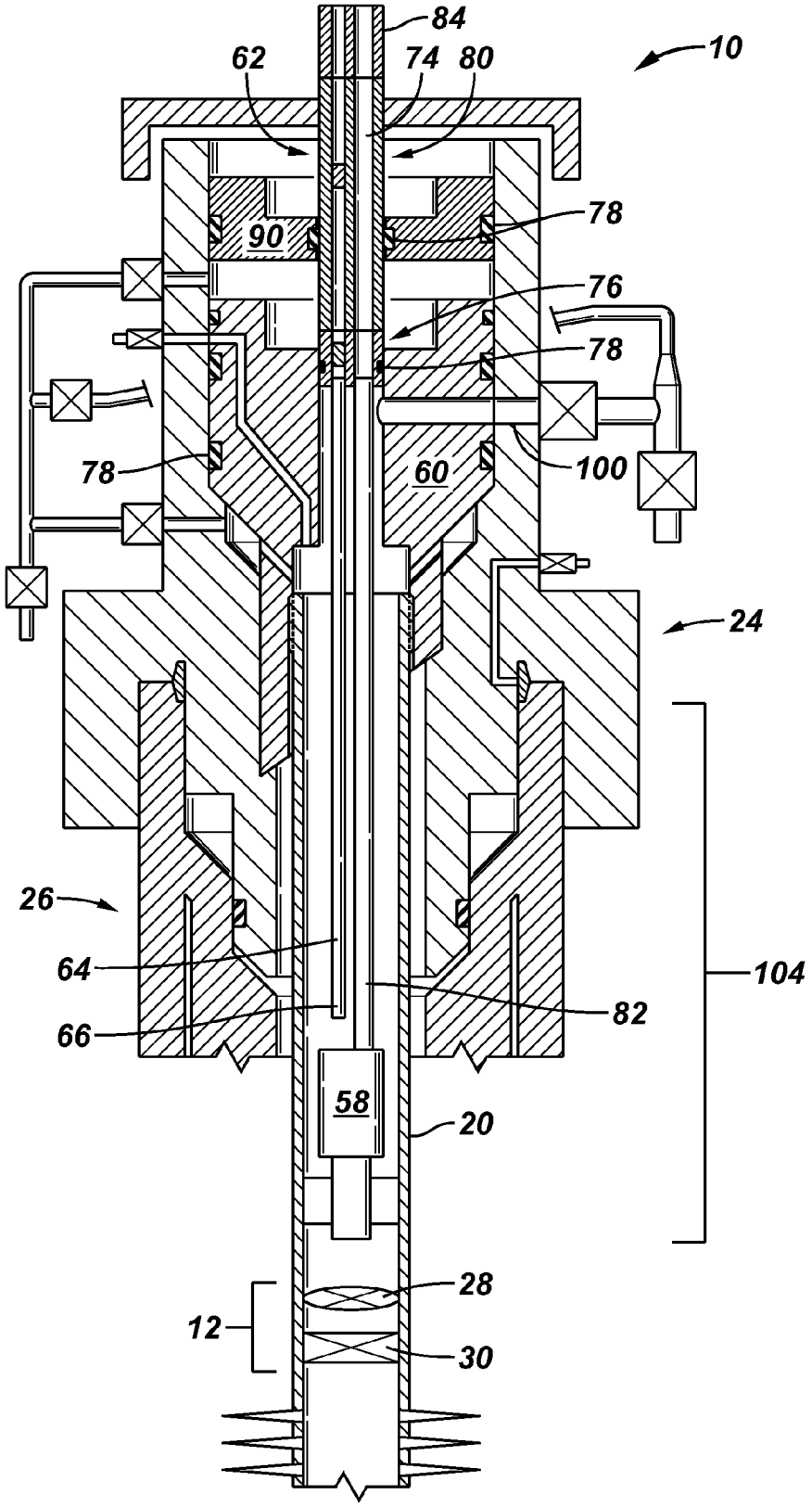
FIG. 6 is a schematic sectional view of a well system comprising the segmented intervention device of FIG. 5 according to one or more aspects of the invention.

An embodiment of a segmented intervention device 62 is now described with reference to FIGS. 5 and 6. In this embodiment, body 61 comprises a separate coil tubing hanger segment 76 operationally connected to an isolation plug segment 80, for example by a wet-connect. At least one isolation plug device 86 is disposed within the portion of fluid conduit 72 of the respective coil tubing hanger segment 76 and the isolation plug segment 80. Coiled tubing segment 76 comprises tubular fluid conduit extension 64 and communication conduit extension 82. According to one or more embodiments of the invention, isolation plug segment 80 may be operationally connected to coiled tubing hanger segment 76 and then installed (i.e., deployed) as a unitary body 61 in the subsea well or coiled tubing hanger segment 76 may be deployed and then isolation plug segment 80 deployed and operationally connected to coiled tubing hanger segment 76.

FIG. 7 is a section view of device 62 along the line I-I of FIG. 3. In the depicted embodiment fluid conduit 72 and communication conduit 74 are formed through body 61. An isolation plug 86 is illustrated disposed in fluid conduit 72. In this embodiment, communication conduit 74 comprises an electric line 92, fiber optic bundle 94, and hydraulic line 96. Seal material 98 is disposed in communication conduit 74. As will be understood by those skilled in the art with benefit of this disclosure, conduits 72 and 74 may be arranged in different configurations without departing from the scope of the invention. For example, communication conduit 74 may comprise one or more individual bores through which an electric line, fiber optic line, or hydraulic line is disposed. Various arrangements of conduits 72 and 74 are also illustrated with reference to end views of coiled tubing 38 (FIG. 2) for connecting at intervention device 62.

As noted above, the number and configuration of interfaces (i.e., conduits) provided by intervention device can vary. Similarly, coiled tubing 38 (FIG. 2) will be configured to operationally connect to the subsea well through the interface of intervention device 62 for example through wet connect 84. With reference to FIG. 2, FIGS. 8 to 10 are end views of non-exclusive embodiments of arrangement of fluid conduit 72 and conduit 74 relative to one another as provided by coiled tubing 38 extending from vessel 32 to intervention device 62.

Figure 8:
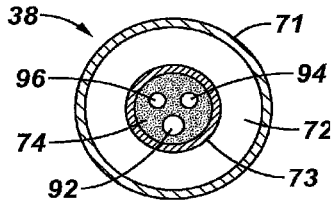
FIGS. 8 to 10 are end views illustrating dual conduits provided through coiled tubing to be connected to the subsea well through the interface of the intervention device.
Figure 9:
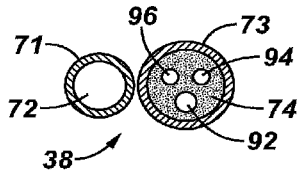
Figure 10:
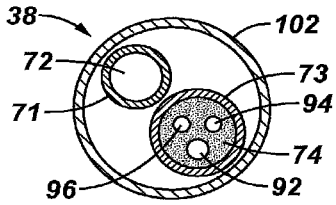

FIG. 8 illustrates an arrangement wherein coil tubing 38 comprises a second coil tubing 73, forming the communication conduit 74, disposed through a first coil tubing 71. Fluid conduit 72 is formed through the annulus between the first and the second coil tubing 71, 73. Communication conduit 74 comprises electrical lines 92, fiber optics 94, and hydraulic lines 96. As depicted in FIG. 2, fluid 54 is circulated through fluid conduit 72 formed between the concentric coiled tubing's 71 and 73 into lubrication section 104 of the subsea well and can be discharged through production line 100 which may be connected to a collection facility and/or vessel 32 (FIG. 1). FIG. 9 is an end view of a side-by-side configuration of a coiled tubing 38 wherein the fluid conduit 72 is provided through coiled tubing 71 and communication conduit 74 is provided by coiled tubing conduit 73. FIG. 10 illustrates another embodiment of coiled tubing 38 wherein fluid conduit 72, i.e., coiled tubing 71, and communication conduit 74, i.e., coiled tubing 73, are arranged side-by-side disposed through an outer coil tubing 102.

An embodiment of subsea system method is now described with reference to FIGS. 1-10 according to one or more embodiments of the invention. A subsea well (e.g., wellbore 14) is completed with a production tubing 20 having a downhole double pressure barrier 12. Production tubing 20 is in fluid communication with tree 24 disposed at wellhead 26. A wellbore device 58, such as an in-well electric submersible pump ("ESP"), is deployed in production tubing 20. A coil tubing hanger 62 comprising tubular extension 64 extending from bottom end 70 of coil tubing hanger 62 is deployed in tubing hanger 60 thereby deploying bottom end 66 of tubular extension 64 in production tubing 20 in the desired position for flushing. Coil tubing hanger 62 includes fluid conduit 72 in fluid communication with tubular extension 64. One or more isolation plug devices 86 are disposed in fluid conduit 72 and can be removed by conventional techniques when desired. A lubricator section 104 is formed in production tubing 20 when lubricator valve 28 and subsea safety valve 30 of downhole double pressure barrier 12 are closed isolating the bottom of the well from the upper section of the production tubing and the isolation plug devices(s) 86 are in the barrier position in fluid conduit 72.

To flush hydrocarbons from production tubing 20, for example to perform an intervention, downhole double pressure barrier 12 is closed. Coiled tubing 38 can be deployed form a surface vessel 32 and stripped into lubricator 46. Isolation plug device(s) 86 can then be removed and coiled tubing 38 can be deployed and operationally connected, for example at wet-connect 84, to fluid conduit 72 of coiled tubing hanger 62. Fluid 54 can then be pumped down coiled tubing 38, through fluid conduit 72, into production tubing 20 and discharged through production line 100 for example, thereby flushing hydrocarbons from production tubing 20.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A subsea well, comprising:

a production tubing comprising a double barrier positioned downhole from a valve tree, the double barrier comprising a safety valve that when closed isolates the production tubing above the double barrier from a pressure zone below the double barrier and a second valve that when closed isolates the production tubing above the double barrier from the pressure zone below the double barrier;

an intervention device deployed in the valve tree, the intervention device comprising a fluid conduit formed through a body, the fluid conduit comprising a tubular extending from the body to a bottom end of the tubular located at a position within the production tubing and above the double barrier; and an isolation plug removably disposed in the fluid conduit.

2. The subsea well of claim 1, wherein the intervention device is deployed in a tubing hanger.

3. The subsea well of claim 1, wherein the intervention device comprises:

the body having a bottom portion sealingly deployed in a tubing hanger; and an upper portion sealing disposed through a tree cap.

4. The subsea well of claim 3, wherein the isolation plug comprises:

a lower isolation plug positioned in the fluid conduit between the tubing hanger and the tree cap; and an upper isolation plug positioned in the fluid conduit above the tree cap relative to the production tubing.

5. The subsea well of claim 1, wherein the intervention device further comprises a communication conduit comprising one selected from an electrical line, an optic fiber, and a hydraulic line.

6. The subsea well of claim 1, wherein the second valve is positioned between the safety valve and the intervention device.

7. The subsea well of claim 1, further comprising a wellbore device landed at a seal assembly installed in the production tubing above the double barrier.

8. The subsea well of claim 1, wherein the intervention device comprises:

the body having a bottom portion sealingly deployed in a tubing hanger;

an upper portion sealing disposed through a tree cap; and the isolation plug comprises a lower isolation plug positioned in the fluid conduit between the tubing hanger and the tree cap and an upper isolation plug positioned in the fluid conduit above the tree cap relative to the production tubing.

9. The subsea well of claim 8, further comprising an electric submersible pump ("ESP") landed at a seal assembly in the production tubing between the intervention device and the double barrier, wherein the fluid conduit extends to the position in the wellbore proximate to the ESP.

10. The subsea well of claim 9, wherein the intervention device further comprises a communication conduit extending into the production tubing, the communication conduit comprising an electric line operationally connected to the ESP.

11. A method for subsea well intervention, comprising:

creating a lubricator section in the subsea well between a double barrier deployed in a production tubing and an intervention device deployed proximate a wellhead, wherein the double barrier comprises a safety valve that when closed isolates the production tubing above the double barrier from a pressure zone below the double barrier and a second valve that when closed isolates the production tubing above the double barrier from the pressure zone below the double barrier;

connecting coil tubing to the lubricator section through the intervention device deployed in the production tubing proximate to the wellhead; and circulating a clean fluid through the coil tubing and the lubricator section.

12. The method of claim 11, wherein the circulating the fluid comprises discharging the fluid from the lubricator section through a production line proximate the wellhead.

13. The method of claim 11, wherein:

the second valve is positioned between the safety valve and the intervention device; and the creating the lubricator section comprises closing at least one of the safety valve and the second valve.

14. The method of claim 11, wherein the intervention device comprises:

a coil tubing hanger deployed in a tubing hanger; and a fluid conduit formed through the coil tubing hanger.

15. The method of claim 14, wherein the circulating the fluid comprises removing an isolation plug disposed in the fluid conduit.

16. The method of claim 14, wherein the intervention device further comprises a tubular extending the fluid conduit from the tubing hanger to a position in the lubricator section proximate to an electric submersible pump that is landed at a seal assembly in the production tubing.

17. The method of claim 16, further comprising connecting an electric source at a surface vessel to the electric submersible pump through the intervention device.

18. A subsea well intervention device, the device comprising:

a body comprising a top end, a bottom end, and a coiled tubing section proximate the bottom end to be sealingly deployed in a tubing hanger;

a fluid conduit formed through the body, the fluid conduit comprising a tubular extending from the bottom end of the body and in-use extending below the tubing hanger;

an isolation plug removably disposed in the fluid conduit; and a communication conduit extending through the body, the communication conduit comprises one selected from the group of an electric line, an optic fiber, and a hydraulic line, wherein the fluid conduit and the communication conduit are positioned side-by-side through the body.

19. The subsea well of claim 1, wherein the production tubing is suspended from a tubing hanger.

* * * * *